United States Patent [19]

Keramati et al.

[11] 4,228,959

[45] Oct. 21, 1980

[54] ROTATING NOZZLE EXPANDER

[75] Inventors: Bahram Keramati; Vedanth Kadambi, both of Scotia, N.Y.

[73] Assignee: General Electric Company, Schenectady, N.Y.

[21] Appl. No.: 935,587

[22] Filed: Aug. 21, 1978

[51] Int. Cl.[2] ..... B05B 1/32

[52] U.S. Cl. ..... 239/451

[58] Field of Search ..... 239/451; 415/71, 72, 415/73, 75

[56] References Cited

U.S. PATENT DOCUMENTS 3,556,670 1/1971 Tucker ..... 415/75

3,697,190 10/1972 Haentjens ..... 415/73

*Primary Examiner*—James B. Marbert

*Attorney, Agent, or Firm*—Robert R. Schroeder; James C. Davis, Jr.; Paul R. Webb, II

[57] ABSTRACT

A rotating nozzle expander is described for the direct expansion of a liquid to a two-phase mixture of liquid and vapor thereby producing mechanical work. The device includes liquid inlet means, at least one fluid flow passage which changes in size in communication with the liquid inlet means, the passage mounted rotatably, the fluid outlet means in communication with the fluid flow passage.

5 Claims, 3 Drawing Figures

ROTATING NOZZLE EXPANDER

This invention relates to a rotating nozzle expander and, more particularly, to such an expander for the direct expansion of a liquid to a two-phase mixture of liquid and vapor.

The present device is useful for power generation from warm liquids when a sink at a lower temperature exists. Such situations arise in bottoming cycles, ocean thermal energy conversion and energy recovery from industrial waste heat.

Current turbomachines are not suitable for the expansion of a liquid to a two-phase mixture. This is primarily due to erosion problems associated with the presence of large quantities of liquid in high velocity vapor which impinges upon rotating blades. The present rotating nozzle expander overcomes these problems by confining the expanding liquid-vapor mixture to an internal flow passage.

The primary object of our invention is to provide a rotating nozzle expander which expands directly a liquid to a two-phase mixture of liquid and vapor, thereby producing mechanical work.

In accordance with one aspect of our invention, a rotating nozzle expander includes liquid inlet means, at least one fluid flow passage which changes in size in communication with the liquid inlet means, the passage mounted rotatably, and fluid outlet means in communication with the fluid flow passage.

These and various other objects, features and advantages of the invention will be better understood from the following description taken in connection with the accompanying drawing in which.

Figure 1:
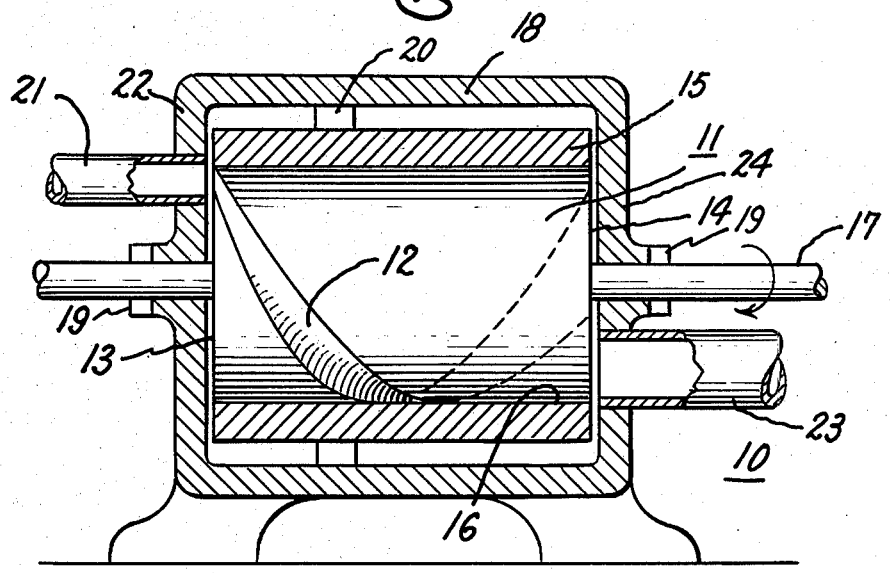
FIG. 1 is a schematic view of a rotating nozzle expander made in accordance with our invention.

In FIG. 1 of the drawing, there is shown generally at 10 a rotating nozzle expander made in accordance with our invention. Expander 10 comprises a rotor 11 with a surface groove 12 thereon which changes in size from one end 13 to the other end 14 of rotor 11. A sleeve 15 encases rotor 11 thereby providing a fluid flow passage within groove 12 and the interior surface 16 of sleeve 15. Rotor 11 has a shaft 17 extending from opposite ends of rotor 11. A housing 18 has rotor 11 and associated sleeve 15 rotatably mounted therein by means of rotor shaft 17. Shaft 17 extends through housing 18, appropriate seals (not shown) and bearings 19 are provided for the openings in housing 18 through which shaft 17 extends outwardly. A seal 20 is provided within housing 18 and is positioned between the interior surface of housing 18 and the external surface of sleeve 15. Liquid inlet means 21 in the form of an inlet pipe is shown connected to a side wall 22 of housing 18 and connects with the inlet of groove 12. Fluid outlet means 23 in the form of a pipe is shown connected to the opposite end wall 24 of housing 18 and communicates with the outlet of groove 12.

Figure 2:
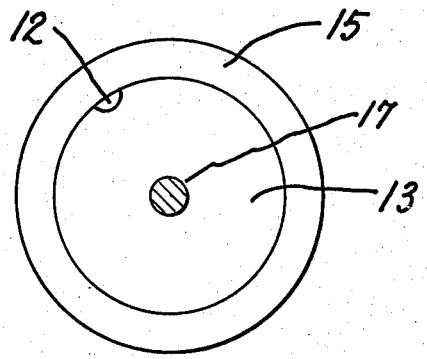
FIG. 2 is an end view of the rotor at the inlet end of the rotating nozzle expander.

In FIG. 2 of the drawing, there is shown an end view of rotor 11 from end 22 of housing 18.

Figure 3:
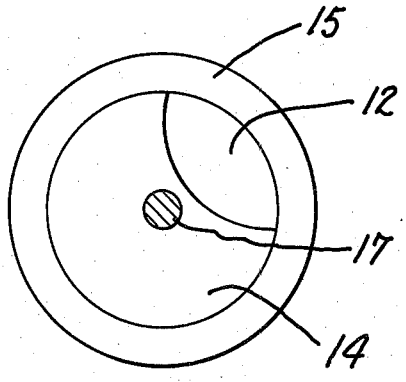
FIG. 3 is an end view of the rotor at the outlet end of the rotating nozzle expander.

In FIG. 3 of the drawing, there is shown an end view of rotor 15 from end 24 of housing 18. Groove 12 is shown where its size is the largest.

In the operation of the rotating expander device as shown in FIGS. 1–3 of the drawing, a liquid, for example, in the form of waste water at a temperature of 140° F. and at a pressure of 14.7 psia is fed to liquid inlet 21 of expander 10. The liquid is made to flow through the passage defined by groove 12 on rotor 11 and interior surface 16 of associated sleeve 15 by means of directing channels (not shown) which are placed at the inlet. The change in the passage area along the rotor depends on the specific design conditions (thermodynamic states) at the inlet and outlet of the rotor. In this example, since the pressure of the water at the inlet is above the saturation pressure at 140° F. (2.89 psia), the pressure needs to be reduced to the saturation pressure (2.89 psia) before vapor generation may begin. This is accomplished in an initially converging passage flow area. It is calculated that at the point of minimum passage flow area, vaporization starts and continues through the passage to the outlet in the diverging section of the groove. At the outlet end of the housing, the resulting two-phase mixture is directed in a direction nearly normal to the rotational axis. Tne momentum of the outflowing two-phase mixture will rotate the rotor and its associated sleeve within the housing. This rotation will rotate the rotor shaft thereby providing mechanical work. The liquid expansion into a two-phase mixture of liquid and vapor will provide a lower temperature liquid at the outlet of the housing, and also provide vapor which can be used subsequently.

Our unique rotating nozzle expander has the capability of providing direct mechanical work, and vapor for certain other applications. The housing can be made of various materials depending on the fluid source.

While a successful expansion of the liquid into a two-phase mixture requires the flow passage size to vary appropriately from the inlet to the exit, several configurations and geometries are possible for the passage shape and of the rotor. For example, the passage may be rectangular or circular in shape, decrease in size first and then increase towards the outlet or increase continuously from the inlet to the outlet, depending upon the conditions of the liquid at the inlet. Similarly, the rotor may be cylindrical, conical or of any other appropriate shape to accomodate the variation in passage size and permit the smooth entry as well as exit of the fluid. Additionally, multiple passages may be employed on the rotor surface to increase the output and obtain a compact device.

While other modifications of the invention and variations thereon which may be employed within the scope of the invention have not been described, the invention is intended to include such as may be embraced within the following claims:

What we claim as new and desire to secure as Letters Patent of the United States is:

1. A rotating nozzle expander comprising a rotor, the rotor having a groove along its length, the rotor groove size changing from one end of the groove to the other end, a sleeve encasing the rotor thereby defining a fluid flow passage, a housing, fluid inlet means for the housing, fluid outlet means for the housing, the rotor and associated sleeve rotatably mounted with the housing, the rotor groove inlet in communication with the fluid inlet means, and the rotor groove outlet in communication with the fluid outlet means.

2. A rotating nozzle expander as in claim 1, in which there are a plurality of flow passages on the rotor.

3. A rotating nozzle expander as in claim 1, in which the rotor flow passage extends around any number of degrees of the rotor surface.

4. A rotating nozzle expander as in claim 3, in which the rotor flow passages extend around any number of degrees of the rotor surface.

5. A rotating nozzle expander as in claim 1 in which the size of the rotor groove disposed on the rotor adjacent the fluid inlet means is smaller than the size of the rotor groove disposed on the rotor adjacent the fluid outlet means.

* * * * *